United States Patent [19]

Watanabe

[11] Patent Number: 4,633,692

[45] Date of Patent: Jan. 6, 1987

[54] DEVICE FOR DETERMINING A SETTING VALUE OF A SHAPE OPERATING AMOUNT IN A ROLLING MILL

[75] Inventor: Fumio Watanabe, Hyogo, Japan

[73] Assignee: Mitsubishi Denki Kabushiki Kaisha, Tokyo, Japan

[21] Appl. No.: 758,063

[22] Filed: Jul. 23, 1985

[30] Foreign Application Priority Data

Aug. 17, 1984 [JP] Japan ..... 59-172023

[51] Int. Cl.[4] ..... B21B 37/12

[52] U.S. Cl. ..... 72/8; 72/16; 72/20; 72/234; 72/243; 364/472

[58] Field of Search ..... 72/8, 6, 16, 20, 234, 72/365, 366, 243; 364/472

[56] References Cited

U.S. PATENT DOCUMENTS

| | | | |
|---|---|---|---|
| 3,882,709 | 5/1975 | Kawamoto et al. | 72/234 |
| 3,927,545 | 12/1975 | Morooka | 72/6 |
| 4,137,741 | 2/1979 | Fapiano et al. | 72/6 |
| 4,458,515 | 7/1984 | Imai | 72/20 |

FOREIGN PATENT DOCUMENTS

| | | | |
|---|---|---|---|
| 0030018 | 3/1981 | Japan | 72/365 |

OTHER PUBLICATIONS

Hiroyuki Simi et al., "A Numerical Model and Control of Plate Crown in the Hot Strip or Plate Rolling", Int. Conf. on Steel Rolling Science and Tech. of Flat Rolled Prod., The Iron & Steel Institute of Japan, Sep. 29/Oct. 4, 1980, pp. 1360–1365.

J. Mignon et al., "New Developments of the Sigma-Ro System for Computer Control in Wide and Narrow Hot Strip Mills", 1st Inter. Conf. on Tech. of Plasticity, Tokyo, Japan, Sep. 3–7, 1984, pp. 399–408.

*Primary Examiner*—Francis S. Husar

*Assistant Examiner*—Steve Katz

*Attorney, Agent, or Firm*—Bernard, Rothwell & Brown

[57] ABSTRACT

A device for determining a setting value of a shape operating amount in a continuous rolling mill having shape controlling means therein. As rolling conditions such as thicknesses, width, rolling loads, roll crown, incoming crown, and incoming flatness are inputted, shape operating amounts are set to attain a constant crown ratio corresponding to a product target crown as early as possible in the first n−1 stands or passes such that as many as possible of the final stands or passes maintain the constant crown ratio to improve the final product flatness.

5 Claims, 5 Drawing Figures

DEVICE FOR DETERMINING A SETTING VALUE OF A SHAPE OPERATING AMOUNT IN A ROLLING MILL

BACKGROUND OF THE INVENTION

1. Field of the Invention

This invention relates to a device for a shape control (crown and flatness control) of a continuous rolling mill, and in particular to a device for determining a setting value of a shape operating amount (rolling force, rolling reduction, etc.).

2. Description of the Prior Art

In continuous rolling mills, it is important to keep the flatness (percentage deviation of plate from being perfectly flat) between stands or passes within an allowable range and to make the flatness as low as possible not only in order to assure product target values of the crown and flatness but also to assure proper passage of the material through the stand or stands. In order to make such shape control effective from a head end of a material, it is necessary to preset a shape control operating amount to an optimum value. In recent years, rolling mills having various shape controlling means have been proposed and placed into practice, but it is not easy to automatically preset a shape control operating amount. Commonly, settings using a predetermined table of values and settings by an operator are employed in most cases, but these settings cannot easily deal with fluctuations of rolling conditions.

An example of attempts of automation is disclosed in "Optimum Setting Controlling Method in Hot Strip Finished Rolling - Crown/Flatness Control Setting -" in The Proceeding of the 1984 Japanese Spring Conference for Technology of Plasticity. This method uses boundary maximum crowns and boundary minimum crowns which can be realized independently at individual stands under an allowable flatness range and an allowable shape operating amount range. Maximum and minimum crowns, from which a product target crown and a product target flatness can be attained, are calculated from each individual stand. Shape operating amounts are determined based on target crowns at the individual stands provided by mean values of such maximum and minimum crowns.

According to this method, the maximum and minimum crowns are calculated while the incoming crown $C_o$ and flatness $f_o$ at the first stand and the outgoing product target crown $C_n^*$ and product target flatness $f_n^*$ at the ultimate stand are restricted, and hence calculations therefor necessitate complicated correcting calculations. The maximum and minimum crowns according to such calculations are converted into crown ratios which are illustrated by dotted lines 17 in FIG. 3 where $C_o=0$ μm, $f_o=0\%$, $C_n^*=50$ μm, and $f_n^*=0\%$ (n=6).

SUMMARY OF THE INVENTION

The present invention has been made in view of such points and in order to provide a device which can simply and automatically determine setting values of optimum shape operating amounts for given rolling conditions.

At first, model equations representative of relationships of the above described crowns, flatnesses and shape operating amounts as well as crown ratios (ratios between crowns and thicknesses) of successive stages of a rolling mill will be described in terms of successive stands of a tandem rolling mill, but such successive stages will also apply to successive passes in a multi-pass rolling mill.

In particular, the outgoing crown ratio $K_i$, crown $C_i$ and flatness $f_i$ at the i-th stand of a tandem rolling mill are given by following equations:

$$K_i = C_i/h_i \tag{1}$$

$$= a_{ki}(x_i) \cdot K_{i-1} + a_i(P_i, C_{Ri}, x_i) \tag{2}$$

$$f_i = b_i(K_i - K_{i-1} + b_{fi} \cdot f_{i-1}) \tag{3}$$

where i is a stand number (i=1 to n, n being the number of the ultimate stand), h an outgoing thickness, x a shape operating amount, P a rolling load, $C_R$ a roll crown, $a_k$ and a are crown ratio influencing functions, and b and $b_f$ flatness influencing coefficients. It is to be noted that $a_k$ is a function of a model parameter determined by rolling conditions such as a thickness, a width and a roll dimension and of the shape operating amount x, and a is represented by a function of a model parameter determined by such rolling conditions, of rolling conditions, that is, P and $C_R$ which are regarded as model parameters for the equation (2), and of the shape operating amount x. b and $b_f$ are model parameters which are determined by a thickness, a width and a roll dimension.

Accordingly, if such rolling conditions and incoming crown $C_o$ and incoming flatnesses $f_o$ for a tandem rolling mill are provided, then the outgoing crown ratios $K_i$, crowns $C_i$ and flatnesses $f_i$ for individual stands will be obtained as a function only of the shape operating amounts $x_i$ from the equations (1) to (3). On the contrary, if the crown ratios $K_i$ are determined, then the shape operating amounts $x_i$ are determined from the equation (2).

It is an object of the present invention to provide a device which (when rolling conditions of a tandem rolling mill such as thicknesses, a width, rolling loads, roll crowns, and incoming crown $C_o$, incoming flatness $f_o$ and so on are provided can assure a product target crown $C_n^*$ and a product target flatness $f_n^*$ by obtaining shape operating amounts $x_i$ to keep the outgoing flatnesses at the first to n-1 stands within allowable ranges, that is, the interstand flatnesses $f_1$ to $f_{n-1}$.

For the object, a method of determining shape operating amounts $x_i$ will be at first described in detail below.

At first, rolling conditions such as thicknesses, width, rolling loads, and roll crowns are inputted.

Secondly, model parameters regarding the crown ratio influencing functions $a_k$ and a and the flatness influencing coefficients b and $b_f$ are calculated.

Thirdly, the maximum crown ratios $K_i^{max}$ and the minimum crown ratios $K_i^{min}$ which can be attained under allowable ranges of shape operating amount and allowable ranges of flatness provided by following equations (4) and (5), respectively, are calculated one after another beginning with the first stand.

$$x_i^L \leqq x_i \leqq x_i^U \tag{4}$$

$$f_i^L \leqq f_i \leqq f_i^U,\ f_n^L = f_n^U = f_n^* \tag{5}$$

In particular, considering, in the right sides of the equations (2) and (3), $$k_{i-1} = K_{i-1}^{max},\ K_o^{max} = K_o = C_o/h_o \tag{6}$$

$$f_{i-1} = f_{i-1}^{max},\ f_o^{max} = f_o \tag{7}$$

the maximum crown ratios $K_i^{max}$ are calculated as follows. It is to be noted that description of the minimum crown ratios $K_i^{min}$ are omitted herein since they can be calculated in a similar manner with the "max" replaced by the "min". The maximum values $K_i^{max1}$ of the crown ratios regarding a shape operating amount limitation are calculated from an equation (8) below by utilizing the equations (2) and (4). It is to be noted that in the equation (8), $x_i^{max1}$ is $x_i^O$ at which $K_i$ becomes maximum, or a lower limit value $x_i^L$ or else an upper limit value $x_i^U$ (that is, $x_i^{max1}$ is $x_i$ at which $K_i$ presents its maximum within a limitation represented by the equation (4)).

$$K_i^{max1}=a_{ki}(x_i^{max1})\cdot K_{i-1}^{max}+a_i(P_i, C_{Ri}, x_i^{max1}) \quad (8)$$

The maximum values $K_i^{max2}$ of the crown ratios regarding a flatness limitation are calculated from a following equation (9) by utilizing the equations (3) and (5), $$K_i^{max2}=f_i^U/b_i+K_{i-1}^{max}-b_{fi}\cdot f_{i-1}^{max} \quad (9)$$

Then, the maximum crown ratios $K_i^{max}$ are calculted from a following equation (10) with the maximum crown ratios $K_i^{max}$ being the minimum values of $K_i^{max1}$ and $K_i^{max2}$.

$$K_i^{max}=\min[K_i^{max1}, K_i^{max2}] \quad (10)$$

Meanwhile, using $K_i^{max}$, flatness $f_i^{max}$ corresponding to the maximum crown ratios are calculated from an equation (11) below originated from the equation (3).

$$f_i^{max}=b_i\cdot(K_i^{max}-K_{i-1}^{max}+b_{fi}\cdot f_{i-1}^{max}) \quad (11)$$

Thus, calculations of the equations (8) to (11) are carried out one after another with i=1 to n so that there may be calculated the maximum crown ratios $K_i^{max}$ (i=i to n) which can be attained under the allowable shape operating amount range and the allowable flatness range. The minimum crown ratios $K_i^{min}$ (i=1 to n) can also be calculated in a similar manner.

Fourthly, taking into consideration limitations of the maximum crown ratios $K_i^{max}$ and the minimum crown ratios $K_i^{min}$ thus calculated and the fact that an influence of $f_{i-1}$ on $f_i$ is low, the target crown ratios $K_i^*$ are calculated as described below so that the flatness $f_i$ may be as low as possible at downstream stands, that is, the constant crown ratio ($K_i=K_{i-1}$) may be maintained at as many stands as possible as can be seen from the equation (3). The most downstream stand k at which the product target crown ratio $K_n^*$ ($K_n^*=C_n^*/h_n$) does not meet $$K_i^{min}\leqq K_n^*\leqq K_i^{max}$$

is calculated by a following expression (12) (the stand k is called the key stand)

$$k=\max[\max(i:K_n^*>K_i^{max}), \max(i:K_n^*<K_i^{min})] \quad (12)$$

Subsequently, for calculation of the target crown ratios $K_i^*$, processes are divided where the key stand is $k<n-1$, $k=n-1$ and $k=n$.

In particular, in the case of $k<n-1$, $$K_i^* = K_i^{max}(1 \leqq i \leqq k);\ \text{when } K_n^* > K_k^{max} \quad (13)$$

-continued $$= K_i^{min}(1 \leqq i \leqq k);\ \text{when } K_n^* > K_k^{min}$$

$$= K_c(k+1 \leqq i \leqq n-1)$$

$$= K_n^*(i=n)$$

$K_c$ in the expression (13) has a constant value and can be calculated if $$K_k = K_k^{max}, f_k = f_k^{max}\ (\text{when } K_n^* > K_k^{max}) \quad (14)$$

$$K_k = K_k^{min}, f_k = f_k^{min}\ (\text{when } K_n > K_k^{min})$$

$$K_n = K^*, f_n = f_n^*$$

$$K_i = K_c\ (i = k+1 \text{ to } n-1)$$

are considered with i=k to n in the equations (2) and (3) (this $K_c$ will be hereinafter referred to as a constant crown ratio).

In case of $k=n-1$, $$K_i^* = K_i^{max}(i = 1 \sim n-1);\ \text{when } K_n^* > K_k^{max} \quad (15)$$

$$= K_i^{min}(i = 1 \sim n-1);\ \text{when } K_n^* < K_k^{min}$$

$$= K_n^*\ (i = n)$$

Meanwhile, in case of k=n, $$K_i^* = k_i^{max}(i = 1 \text{ to } n);\ \text{when } K_n^* > K_k^{max} \quad (16)$$

$$= K_i^{min}(i = 1 \text{ to } n);\ \text{when } K_n^* < K_k^{min}$$

In this case, since the product target crown ratios $K_n^*$ cannot be assured, $K_n^*$ is changed by $K_n^{max}$ or $K_n^{min}$. It is to be noted that the changed value can possibly be $K_n^*$ defined as $K_n^{min}<K_n^*<K_n^{max}$, and in such a case, the equation (13) or (15) $K_i^*$ may be calculated.

Fifthly, if the target crown ratios $K_i^*$ (i=1 to n) calculated by the equation (13) or (15) or (16) is substituted into the equation (2) and is resolved over $x_i$, then the shape operating amounts $x_i$ which can attain the aforementioned object of the present invention can be calculated as a following equation (17).

$$x_i=g_i(K_i^*, K_{i-1}^*, P_i, C_{Ri}) \quad (17)$$

BRIEF DESCRIPTION OF THE DRAWINGS

FIG. 2A illustrating skew angles, FIG. 2B flatnesses, and FIG. 2C target crown ratios.

DETAILED DESCRIPTION OF THE PREFERRED EMBODIMENT

A preferred embodiment of the present invention will be described in detail below with reference to the accompanying drawings.

The embodiment includes a 6-stand tandem rolling mill having shape controlling means in the first to sixth stands thereof to which mill the present invention is applied which relates to a device for determining optimum shape operating amounts corresponding to given rolling conditions as described hereinabove.

Figure 1:
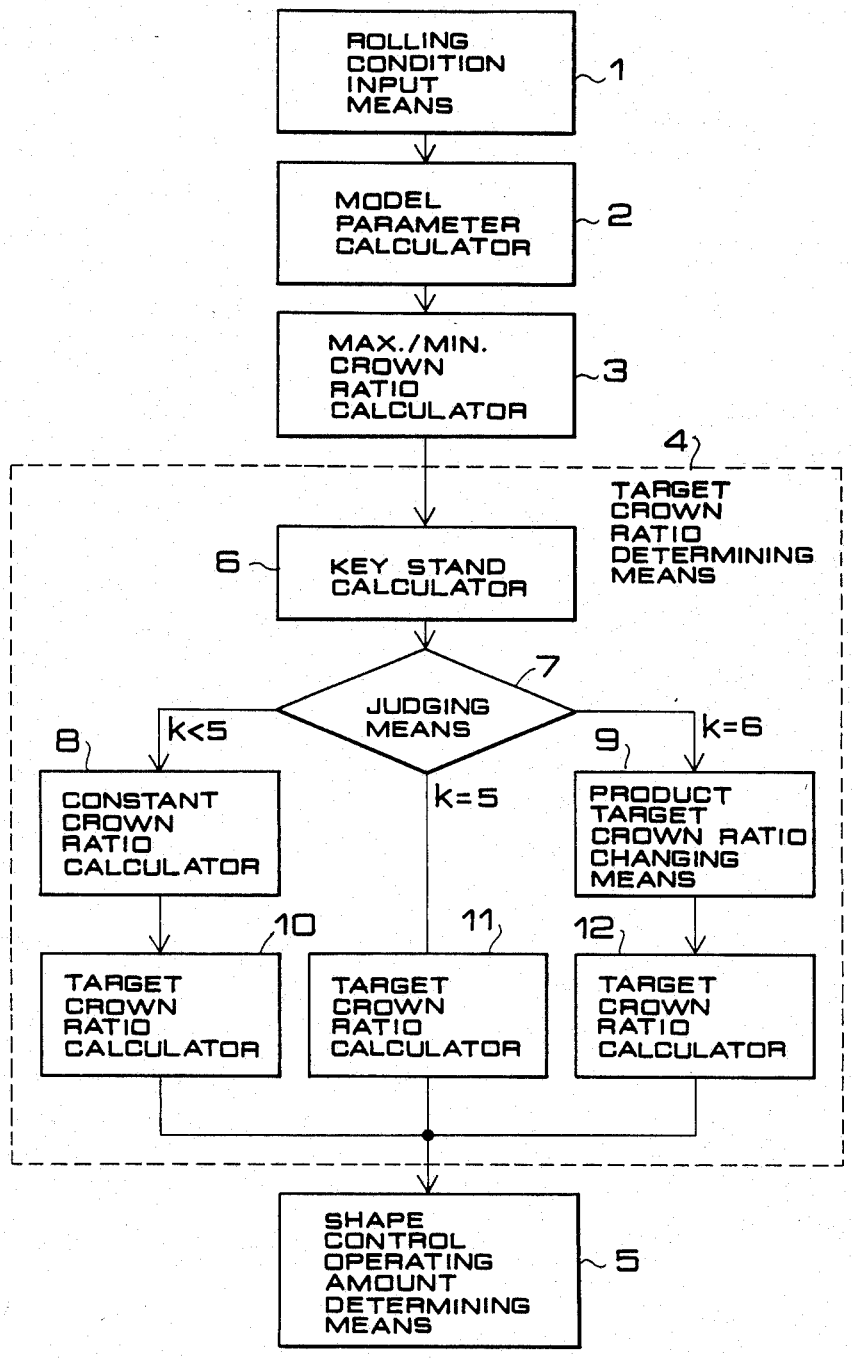
FIG. 1 is a block diagram illustrating an embodiment of the present invention.

Referring to FIG. 1, the device includes a rolling condition input means 1 for inputting rolling conditions such as thicknesses, width, rolling loads and roll crowns, a model parameter calculating means 2 for calculating model parameters of crown ratio and flatness models as represented by the equations (2) and (3), a maximum/minimum crown calculating means 3 for calculating maximum and minimum crown ratios, a target crown ratio determining means 4 for determining target crown ratios, and a shape control operating amount determining means 5 for calculating and determining setting values of shape operating amounts. The target crown ratio determining means 4 includes a key stand calculating means 6 for calculating the number of a key stand for judging from which stand a constant crown ratio is possible, a judging means 7 for judging means for calculating target crown ratios based on the key stand number, a constant crown ratio calculating means 8 for calculating the constant crown ratio, a product target crown ratio changing means 9 for changing a product target crown ratio, and target crown calculating means 10, 11 and 12 for calculating target crown ratios.

The device for determining setting values of shape operating amounts in a rolling mill according to the present invention includes such means as described just above, and if rolling conditions are inputted at the means 1, then the means 2 calculates model parameters of the equations (2) and (3) based on the rolling conditions thus inputted. Then, the means 3 calculates maximum crown ratios $K_i^{max}$ and then minimum crown ratios $K_i^{min}$ from the equations (8) to (11), using the model parameters thus calculated and the rolling conditions (the rolling loads and the roll crowns) as well as an allowable ranges of shape operating amounts and an allowable ranges of flatnesses represented by the equations (4) and (5), respectively. Then, the means 4 determines target crown ratios $K_i^*$ within a limitation range provided by $K_i^{max}$ and $K_i^{min}$ thus calculated. In particular, at first the means 6 calculates a key stand number k for judging from which stand the constant crown ratio is possible depending upon relations of magnitude of the product target crown ratio $K_n^*$ to $K_i^{max}$ and $K_i^{min}$ calculated by the means 3. Then, a value of k is judged by the means 7, and if $k<5$, then the means 8 is rendered operative, if $k=5$, the means 11 is rendered operative and if otherwise $k=6$, then the means 9 is rendered operative. Then, the means 8 calculates the constant crown ratio $K_c$ from the equation (14), and the means 10 calculates the target crown ratios $K_i^*$ from the equation (13), using the constant crown ratio $K_c$ and the product target crown ratio $K_n^*$ as well as the calculated values $K_i^{max}$ or $K_i^{min}$. Otherwise, the target crown ratio calculator 11 calculates the target crown ratio $K_i^*$ from the equation (15). Or otherwise, the means 9 changes the product target plate crown ratio $K_n^*$ to the calculated value $K_n^{max}$ or $K_n^{min}$, and the means 12 calculates from the equation (16) the target crown ratios $K_i^*$ for attaining the thus changed target crown ratio. Finally, the means 5 calculates from the equation (17) shape operating amounts $x_i$, as shape operating amount setting values, for realizing the target crown ratios $K_i^*$ determined by the means 4 (that is, either by the means 10 or by the means 11 or by the means 12). It is to be noted that the suffix i in the $x_i$ above may be 1 to 6.

Figure 2A:
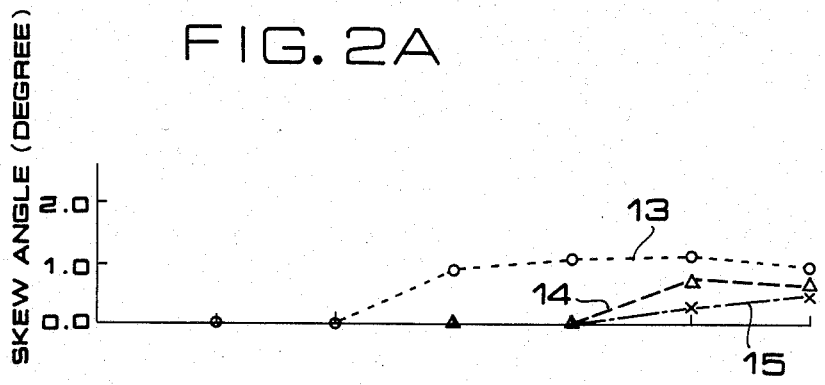
FIGS. 2A to 2C are views illustrating results of the embodiment of the invention.
Figure 2B:
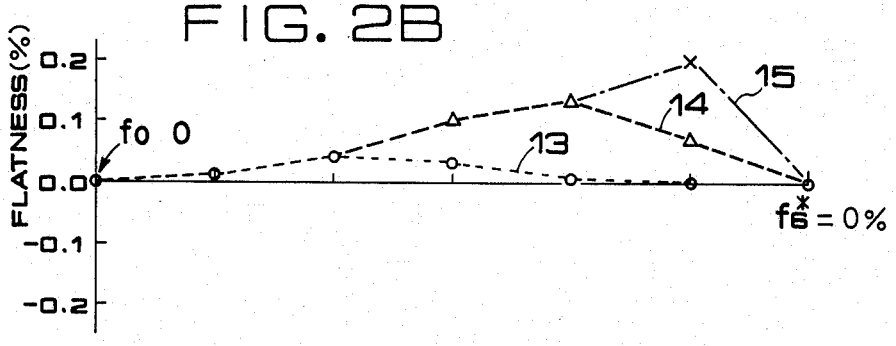
Figure 2C:
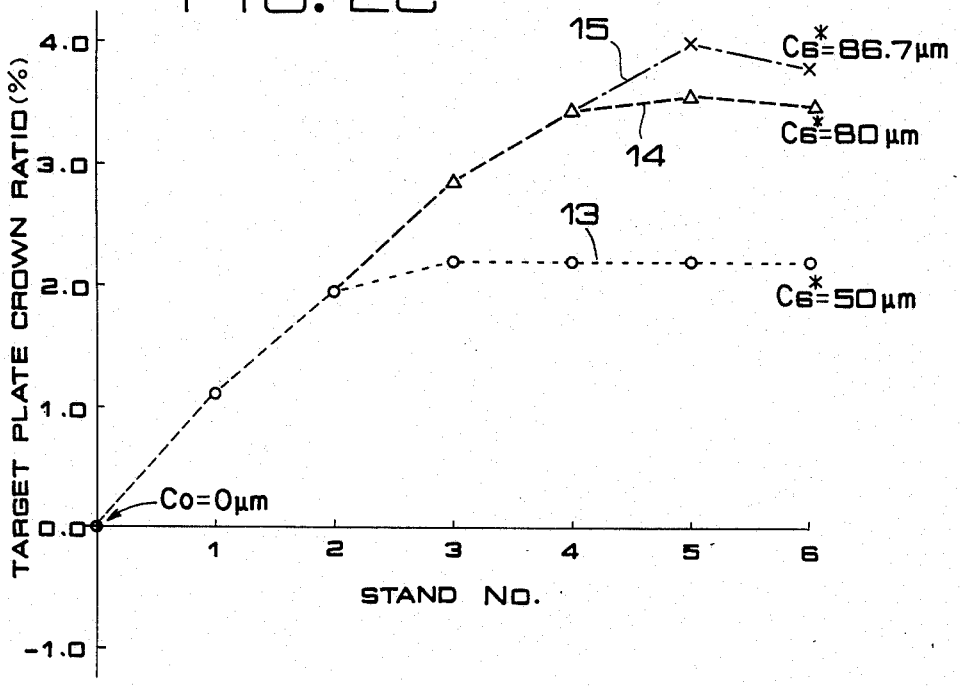

FIGS. 2A to 2C illustrate results attained by a device for determining a setting value of a shape operating amount according to the present invention wherein a shape operating amount is a skew angle of a skew roll mill (a horizontal angle provided by upper and lower work rolls). In these figures, dotted lines 13, broken lines 14 and dot and dash lines 15 indicate changes among the stands of the skew angles, flatnesses and crown ratios (that is, the target crown ratios) where the product target crown is $C_6^*=50$ μm (where the product thickness is $h_6=2.34$ mm, the product target crown ratio $K6^*=2.14\%$), $C_6^*=80$ μm ($K_6^*=3.42\%$), and $C_6^*=100$ μm ($K_6^*=4.27\%$), respectively. Referring to FIG. 2, in the case of the dotted line 13 ($C_6^*=50$ μm), the product target crown $C_6^*$ is assured and the key stand number becomes $k=2$, and hence the flatnesses are reduced at later stands by keeping constant the crown ratios of the third to fifth stands. Meanwhile, in the case of the broken lines 14 ($C_6^*=80$ μm), the product target crown $C_6^*$ is assured and the key stand number becomes $k=4$, the outgoing flatness at the fifth stand is reduced. Further, in the case of the dot and dash lines 15 ($C_6^*=100$ μm), the key stand number becomes $k=6$ and the product target crown $C_6^*$ cannot be assured, and hence $C_6^*$ is changed to $C_6^*=86.7$ μm ($K_6^*=K_6^{max}=3.71\%$). It is to be noted that changes of the target crown ratios among the stands then naturally become the same as changes of the maximum crown ratios.

In any of the cases described above, the product target flatness $f_6^*=0\%$ is assured, and the allowable skew angle range $0° \leqq x_i \leqq 2°$ (i=1 to 6) and the allowable flatness range $-0.2\% \leqq f_i \leqq 0.2\%$ (i=1 to 5) are also met.

Figure 3:
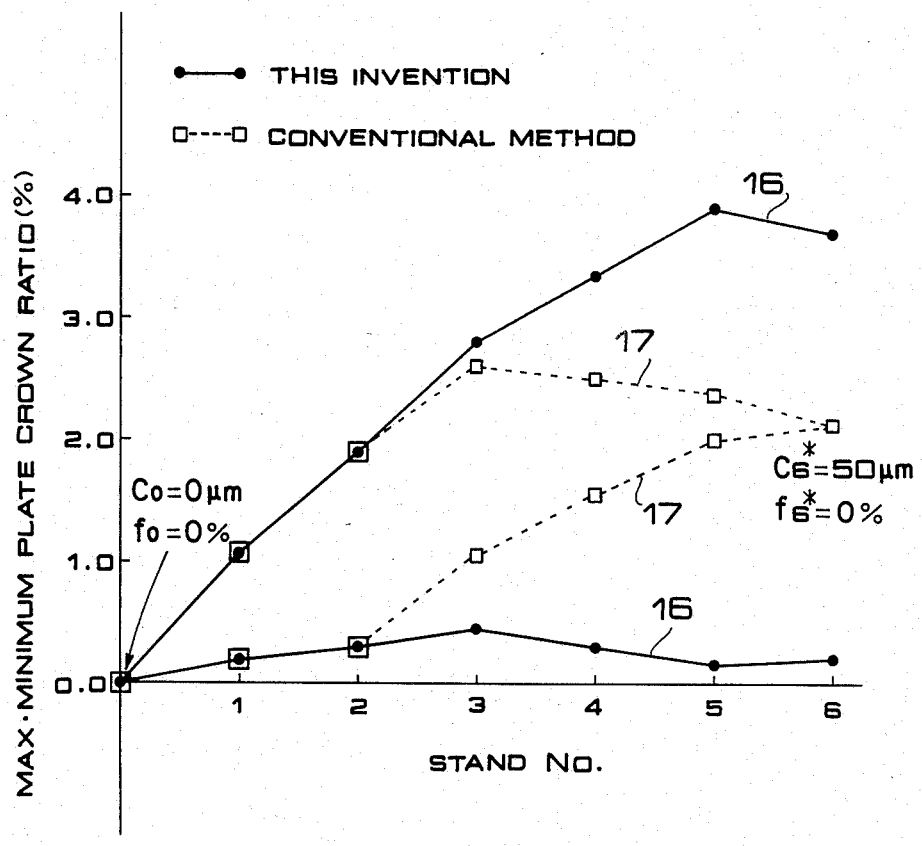
FIG. 3 is a diagram for comparison of maximum and minimum crown ratios between the present invention and a conventional device.

Changes among the stands of the maximum crown ratio and the minimum crown ratio obtained by the means 3 are illustrated by solid lines 16 in FIG. 3. The maximum and minimum crown ratios obtained by a conventional device as illustrated by dotted lines 17 depend upon the product target crown $C_6^*$ and the product target flatness $f_6^*$, but according to the present invention, they do not depend upon the same. In other words, the maximum and minimum crown ratios are different in definition between the device of the invention and conventional devices.

It is to be noted that while the embodiment described above includes shape controlling means in the first to sixth stands thereof, where shape controlling means is included in one or more given stands, the upper and lower limit values $x_i^U$ and $x_i^L$ of the allowable shape operating amount range of the equation (4) may be both zero at the other stands which do not include such shape controlling means therein.

Further, while in the embodiment described the roll crown is inputted as a rolling condition, it may otherwise be calculated from other rolling conditions such as the rolling load and the rolling time, without departing from the spirit of the invention.

In addition, while description has been only given of the results attained where the shape operating amount is a skew angle of a skew roll mill, naturally a shape operating amount may otherwise be any amount which can change a shape of a work such as a bending force or an intermediate roll shift amount of a 6-high mill.

As apparent from the foregoing description, according to the present invention, setting values of optimum shape operating amounts to given rolling conditions can automatically and easily determined.

In addition, according to the invention, not only product target values of a crown and flatness can be assured directly after beginning of rolling, but rolling is made possible wherein a flatness between passes is minimized within an allowable range. Hence, the present invention presents large effects in that it contributes to improvements in quality of products and to stabilized rolling operation.

What is claimed is:

1. A device for determining setting values of shape operating amounts in a rolling mill having shape controlling meansin crown and flatness control, comprising:

(a) rolling condition input means for inputting rolling conditions such as a thickness, a plate width and a rolling load;

(b) model parameter calculating means connected to said rolling condition input means for receiving an output of said rolling condition input means to calculate parameters of crown and flatness models;

(c) maximum and minimum crown ratio calculating means connected to said model parameter calculating means for receiving an output of said model parameter calculating means to calculate a maximum crown ratio and a minimum crown ratio;

(d) target crown ratio determining means connected to said maximum and minimum crown ratio calculating means for receiving an output of said maximum and minimum crown ratio calculating means to determine a target crown ratio; and (e) shape operating amount determining means connected to said target crown ratio determining means for receiving an output of said target crown ratio determining means to determine a setting value of a shape operating amount.

2. A device according to claim 1, wherein said target crown ratio determining means includes key stage calculating means responsive to an output of said maximum and minimum crown ratio calculating means for calculating a key stage number corresponding to which stage a constant crown ratio is possible, a judging means responsive to the key stage calculating means for judging the key stage, a constant crown ratio calculating means for calculating a constant crown ratio , a product target crown ratio changing means for changing a product target crown ratio, and a target crown ratio calculating means; said constant crown ratio calculating means, said product target crown ratio changing means and said target crown ratio calculating means being selectively rendered operative by the results of judgment of said judging means.

3. A device according to claim 2, for determining setting values for shape operating amounts in a multipass rolling mill wherein said key stage calculating means calculates a key pass number.

4. A device for determining setting values of a plurality of three or more successive shape operating amounts for a corresponding plurality of successive stages in a rolling mill to control crown and deviation from flatness in the rolled product, comprising:

(a) rolling condition input means for inputting rolling conditions including plate thickness, plate width, rolling load, and roll crown;

(b) model parameter calculating means connected to said input means and responsive to the input means for calculating parameters of crown ratio influencing functions and flatness influencing coefficients from the inputted rolling conditions;

(c) maximum and minimum crown ratio calculating means connected to said model parameter calculating means and responsive to both the model parameter calculating means and the rolling condition input means for calculating successive maximum crown ratios and successive minimum crown ratios from the crown ratio influencing functions, the flatness influencing functions and the inputted rolling conditions for the respective successive stages beginning with the first stage; said maximum and minimum crown ratios being calculated using allowable ranges of shape operating amounts to produce flatness values within allowable ranges of flatness values;

(d) target crown ratio determining means connected to said maximum and minimum crown ratio calculating means and responsive to the maximum and minimum crown ratio calculating means for determining target crown ratios for the respective successive stages beginning with the first stage wherein each target crown ratio is within the range of ratios defined by the calculated maximum crown ratio and calculated minimum crown ratio of the respective stage; said target crown ratios further being determined to produce a constant crown ratio at as many as possible of the last stages such that deviation from flatness of the product is minimized; and (e) shape operating amount determining means connected to said target crown ratio determining means and responsive to both the rolling condition input means and the target crown ratio determining means for determining the setting values of the shape operating amounts from the inputted rolling conditions and the determined target crown ratios for the respective successive stages.

5. A device according to claim 4 wherein said target crown ratio determining means includes:

key stage determining means for determining a key stage at which the respective target crown ratio can first equal the constant crown ratio;

judging means connected to the key stage determining means for operating one of the following three branches depending upon the key stage being before the next ot last stage, being the next to last stage, and being the last stage;

first branch means, responsive to the judging means operating in response to the key stage being before the next to last stage, including constant crown ratio calculating means for calculating the constant crown ratio, and first target crown ratio calculating means for calculating the target crown ratios of the key stage and the following stages on the basis of the constant crown ratio and a product crown ratio;

second branch means, responsive to the judging means operating in response to the key stage being the next to last stage, including second target crown ratio calculating means for calculating the target crown ratios of the last two stages on the basis of the product crown ratio;

third branch means, responsive to the judging means operating in response to the key stage being the last stage, including product crown ratio changing means for changing the product target crown ratio to one of the maximum and minimum crown ratios of the last stage when the product crown ratio is outside of the range defined by the maximum and minimum crown ratios of the last stage, and third target crown ratio calculating means for calculating the target crown ratio of the last stage on the basis of the product crown ratio as it may have been changed.

* * * * *